US006595343B1

(12) United States Patent
Tanaka et al.

(10) Patent No.: US 6,595,343 B1
(45) Date of Patent: Jul. 22, 2003

(54) COIN ROLLING-TYPE SELECTOR

(75) Inventors: Yoshinobu Tanaka, Iwatsuki (JP); Hiroshi Abe, Iwatsuki (JP)

(73) Assignee: Asahi Seiko Kabushiki Kaisha (JP)

( * ) Notice: Subject to any disclaimer, the term of this patent is extended or adjusted under 35 U.S.C. 154(b) by 171 days.

(21) Appl. No.: 09/706,164

(22) Filed: Nov. 4, 2000

(30) Foreign Application Priority Data

| | | |
|---|---|---|
| Feb. 15, 2000 | (JP) | 2000-036091 |
| Mar. 28, 2000 | (JP) | 2000-088984 |
| Jul. 17, 2000 | (JP) | 2000-215970 |

(51) Int. Cl.[7] ..... G07F 1/04
(52) U.S. Cl. ..... 194/344; 194/334; 194/229
(58) Field of Search ..... 194/344, 336, 194/337, 239, 334

(56) References Cited

U.S. PATENT DOCUMENTS

| | | | | |
|---|---|---|---|---|
| 3,837,454 A | * | 9/1974 | Joeck | 194/344 X |
| 5,293,981 A | | 3/1994 | Abe et al. | |
| 6,283,267 B1 | * | 9/2001 | Tanaka | 194/334 |

FOREIGN PATENT DOCUMENTS

| | | | | |
|---|---|---|---|---|
| JP | 6-25963 | | 4/1994 | |
| JP | 8-24434 | | 1/1996 | |
| JP | 2000-123217 | | 4/2000 | |
| NL | 70737 | * | 9/1952 | 194/336 |

* cited by examiner

*Primary Examiner*—Dean J. Kramer
*Assistant Examiner*—Thuy V. Tran
(74) *Attorney, Agent, or Firm*—McGlew and Tuttle, P.C.

(57) ABSTRACT

A coin selector is provided with a decreased size as compared with prior art devices, which is also lighter. The selector, uses synthetic resin molded product componenets. The selector has a base element which has a shape such as a roughly square thick plate being stood up; a rail being arranged on this base element, for standing up and rolling a deposited coin; and a roller with a groove. The roller is freely rotatable arranged above this rail. The roller guides the upper edge of said rolling coin.

8 Claims, 17 Drawing Sheets

COIN ROLLING-TYPE SELECTOR

FIELD OF THE INVENTION

This invention relates generally to a coin selector for sorting out whether a deposited coin is genuine or not by rolling thereof. This invention more particularly relates to a rolling style coin selector which is used for game machines such as slot machine, pachinko-slot machines and other devices. The terminology "coin" used in this specification should be interpreted to include coins of a small disk shape including currency. The terminology "coin" should also be construed in this specification to include disk-like medals and tokens used in games, etc.

BACKGROUND OF THE INVENTION

Until now, rolling type coin selectors have been used for medal/awards game machines and pachinko-slot machines, etc. A rolling style coin selector is disclosed in Japanese Utility Model Application 4-23240 by the present applicant. The rolling coin selector which is described in Japanese Utility Model Application 4-23240 is laid-open to public inspection as Japanese Utility Model Disclosure 6-25963. This rolling coin selector is also disclosed in U.S. Pat. No. 5,293,981.

The rolling coin selector which is disclosed in Japanese Utility Model Application 4-23240 is summarily shown by a perspective view in FIG. 14A. A sectional view of this rolling coin selector is also shown in FIG. 14B. In rolling coin selector which is shown in FIGS. 14A and 14B, the coin is deposited or inserted into an upper charge mouth 1. The deposited coin rolls and falls on straight line rail 7, which is formed at the lower edge of large frame 4. When the coin A is genuine, the roll continues, being held between thin plate guide 10 and door board 5 (refer to FIG. 14B). When the coin A is not genuine and has a small diameter, the coin A falls, dropping off of guide 10 or door board 5.

When coin A is not genuine and has a large diameter, the coin A does not roll, being stopped by guide 10, etc. In this case, when door board 5 is moved against a spring (not shown), arm 11 will also be moved, via existing hinge shaft 8. Thus, the coin which is stopped by guide 10, etc. falls.

A greatly improved rolling coin selector is disclosed in Japanese Patent Application 10-324355 by the present applicant. The rolling coin selector which is described in Japanese Patent Application 10-324355 is laid-open to public inspection as Japanese Patent Disclosure 2000-123217. The rolling style selector, which is disclosed in Japanese Patent Application 10-324355 is summarily shown on the front elevation view of attached FIG. 15. FIG. 16 is a summary sectional view in which FIG. 15 is observed from the left side. The rolling coin selector which is disclosed in Japanese Patent Application 10-324355 is used in the condition shown in FIG. 16. This rolling coin selector is used, by forming a rough section-V-shaped small groove 56 by means of paired rollers 53 and 55. In this condition, coin C is inserted into upper part opening 21 of the selector. The inserted coin C is guided and rolled via circular arc way 22 (refer FIG. 15). Then, when this coin C, which is sorted out is genuine, circular arc way 22 will be passed through. That is, the lower edge of genuine coin C is guided by circular arc way 22. Simultaneously, the upper edge of genuine coin C is guided by small groove 56 of paired rollers 53 and 55. Therefore, when the coin C is a genuine coin, circular arc way 22 will be smoothly passed.

In this practical example, paired rollers 53 and 55 are freely rotatable. As a result of this, genuine coin C will smoothly and swiftly pass circular arc way 22. When the coin which is put in opening 21 is not genuine, circular archway 22 win not be passed. For example, when the diameter of the deposited coin is small, circular arc way 22 will not be passed. That is to say, when the diameter of deposited coin is small, the coin falls, deviating from the above small groove 56. However, when the small diameter coin vibrates, the apparent size of this coin increases and becomes like a genuine coin. In this case, spring 57 acts on this coin (refer FIG. 16). That is, spring 57 will absorb the vibration of the coin. As this result, the small diameter coin falls, coming off from paired rollers 53 and 55. When the diameter of coin which is deposited in opening 21 is great, circular arc way 22 will also not be passed. For example, the upper edge of diameter-greater coin is struck to and stopped at rollers 53 and 55. In this case, by opening and closing the door 31 around the above hinge shaft 32, the coin, with the big diameter, falls.

SUMMARY AND OBJECTS OF THE INVENTION

The invention is based on the observation that the conventional rolling style coin selector was laterally big. The size generally was too great as to the conventional roll style coin selector. In addition, there was a problem that the conventional roll style coin selector was heavy, since most parts were metallic.

It is an object of the invention to solve the above-mentioned problems.

It is another object of the invention to decrease the size of whole selector and to provide a selector that is lighter on the whole.

According to the invention, a coin selector is provided including synthetic resin molded products.

Still another object of the invention is to provide simplified size change features with the change of the selection coin.

According to the invention, a coin rolling type selector is provided comprising a base element which has a shape such as a roughly square thick standing up plate, a rail arranged on this base element, and a roller with a groove. The roller is freely rotatable and arranged above this rail. The roller guides the upper edge of the rolling coin.

The rail is preferably a slender metal and is detachably fixed on the base element. The roller is preferably a resin molded product and is detachably fixed on said base element.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 12 is a summary sectional view in which FIG. 11 is observed from the little lower of right side;

DESCRIPTION OF THE PREFERRED EMBODIMENTS

Figure 1:
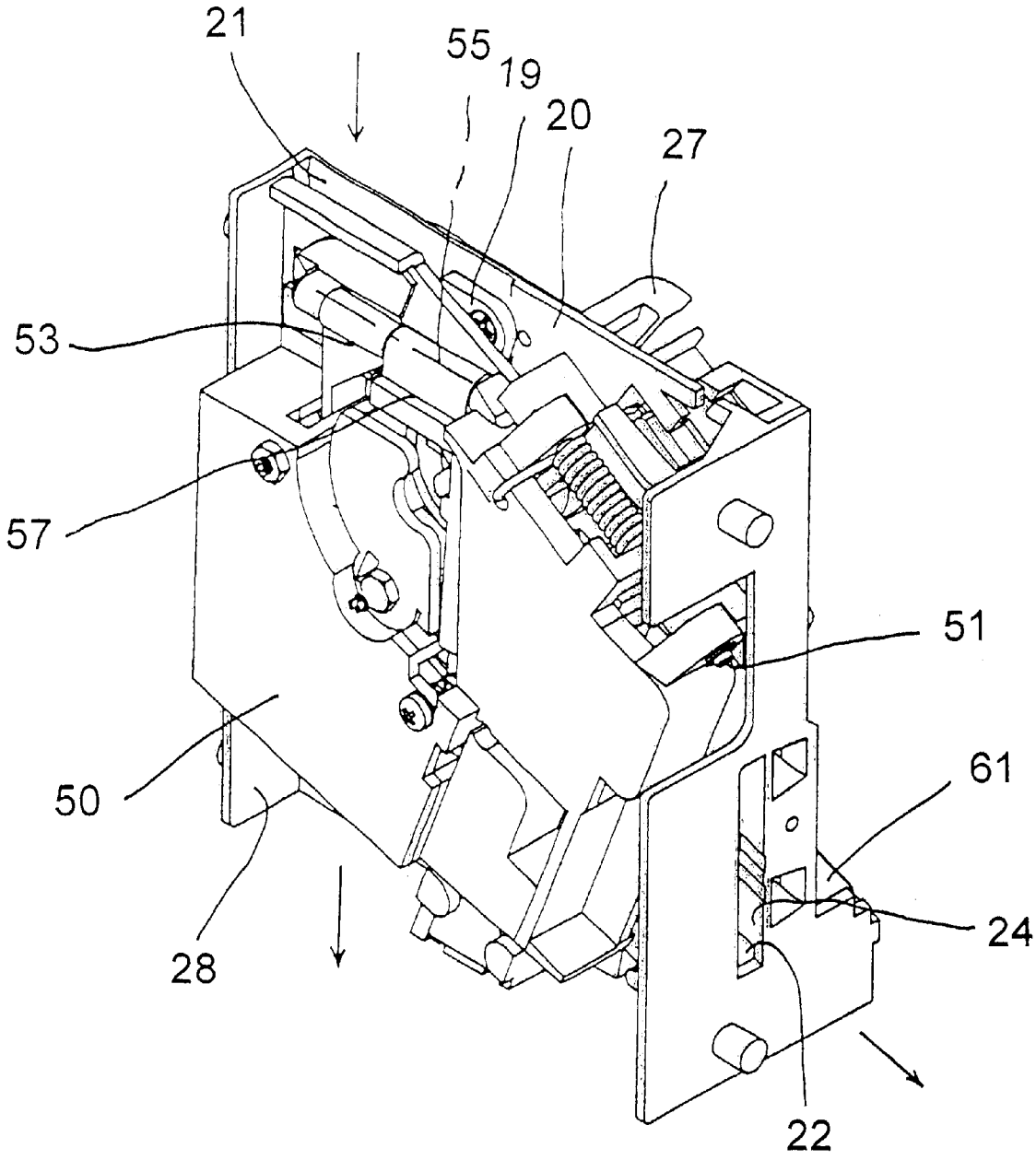
FIG. 1 is a summary perspective view in which an embodiment according to this invention is diagonally observed from the upper front face.

Referring to the drawings in particular, an embodiment according to this invention is shown of a roll style coin selector. The coin selector has a standing up shape of a flat box (refer FIG. 1). A generally pentagon-shaped cover body 50 is pivoted at 51 on the upper part of summarily square-shaped base element 20. The cover body 50 is a hollow synthetic resin molded product.

Figure 5:
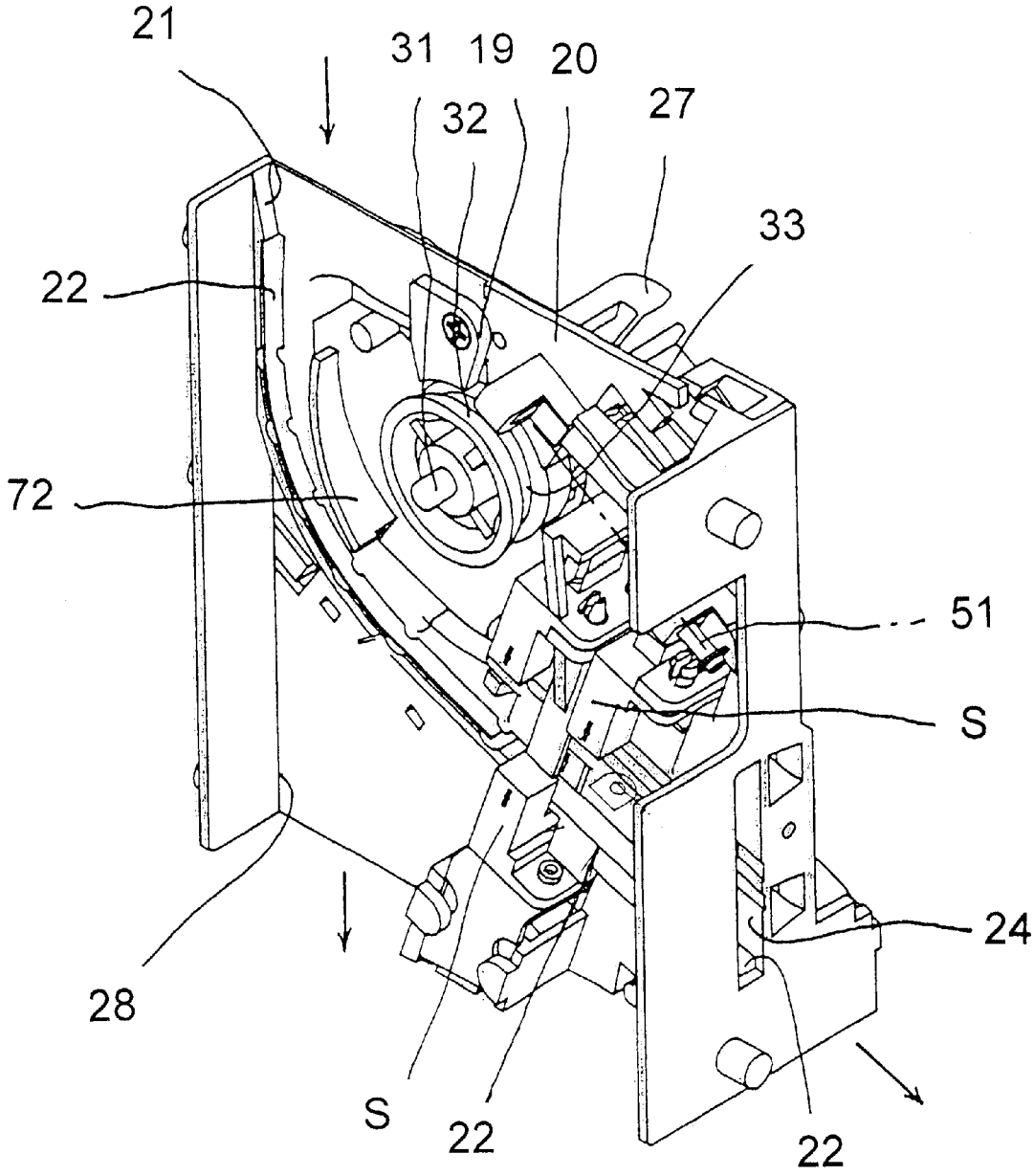
FIG. 5 is a summary perspective view showing the practical example of FIG. 1 with a part removed.

FIG. 5 shows the cover body 50 removed. The coin is deposited through opening 21 which is formed at the upper corner of the selector. A guide piece 19 can be adjusted in proportion to the diameter of the coin is fixed near opening 21 by screw. The coin is deposited from opening 21 and is guided to an exit 24 by a rail 22 which is bent downward (refer FIG. 5). The coin which is put from the top corner of selector stands and rolls toward the bottom corner. When the rolling of the coin, which is deposited from the top corner of the selector is stopped, this coin falls at the nearest bottom corner. The coin, deposited through opening 21, stops its rolling and falls into a cancel path 28 of the bottom. Slender metallic rail 22 is detachably fixed on base element 20 which is a resin molded product. A narrow groove is downwardly bent from the top corner to the farthest bottom corner of the base element 20. The rail 22 is fitted to this groove, resisting the elastic force. On the base element 20 near opening 21, a window 23 with a generally sector-shaped dent is opened (refer to FIG. 6). Near the lower edge part of this window 23, a generally cruciform cancel body 25 is pivoted at 26 (refer to FIG. 3). A crescent moon piece 25M which is a horizontal end part of the cancel body 25 is placed to open and close the window 23. The cancel body 25 is made as a resin molded article for detaching and canceling the coin which is stuffed in the equipment. At the tip of the L-shaped upper end part 25T of the cancel body 25, a protrusion 25P is formed (refer to FIG. 9). This protrusion 25P is used as an operation piece for opening and closing the cover body 50, resisting the spring. The upper end part 25T of the cancel body 25 is almost inserted into an angle case 25C with a groove on base element 20.

At the base element 20, which is the point position of sector-shaped window 23, a metallic projected shaft 31 is fixed toward the cover body 50. A generally L-formed cancel lever 27 is shown properly arranged at the upper part of FIG. 3. The cancel lever 27 is made as a resin-molded article. This cancel lever 27 is freely rotatably mounted on the outside end of projected shaft 31. When this cancel lever 27 is rotated around the projected shaft 31, cancel body 25 is rotated at the center line of pivot shaft 26. As a result of this, window 23 is opened and closed by the crescent moon piece 25M of the cancel body 25. On the inner end part of projected shaft 31, a roller 32 formed as a resin mold article, is freely rotatable and detachably mounted. On the whole circumference at the outside end part of roller 32, a groove 33, which has a generally U-shape in cross section is formed (refer to FIG. 5). This groove 33 is for guiding the upper part of the circumference edge of the standing coin which rolls down the rail 22. The outside top face of groove 33 is formed as a slope. The edge of coin would is due to be guided into the groove 33 of roller 32.

As described above, cover body 50 is formed as a hollow resin-molded article with a generally pentagon shape. The upper part of cover body 50 is installed to be freely openable at the upper part of base element 20, by means of pivot shaft 51 and spring. Further, a little small J-shaped pushing piece 53 is pivoted at 55 on the cover body 50, at each upper part thereof (refer to the right side of FIG. 2). Pushing piece 53, which is a resin molded article, is extended into cover body 50 in a freely swingable manner. This pushing piece 53 lightly presses the passing coin on the base element 20 to absorb the vibration of the coin. A small spring 56 is placed between cover body 50 and pushing piece 53 (refer to FIG. 2). On pivot shaft 55, a s-shaped press piece 57 is freely swingably mounted. This press piece 57 is a resin-molded article and presses roller 32 to base element 20 lightly, by the protrusion 54 thereof. The roller 32 is accurately positioned by the protrusion 54 at the middle of press piece 57. Therefore, a small spring 58 is placed between press piece 57 and cover body 50 (refer to FIG. 2). The long press piece 57 becomes free from the cover body 50 by means of this spring 58. Even if cover body 50 is opened and closed upon canceling, etc., press piece 57 is resting. Thus, the coin is guided to the cancel road 28 by press piece 57, even if cover body 50 is opened and closed.

Figure 2:
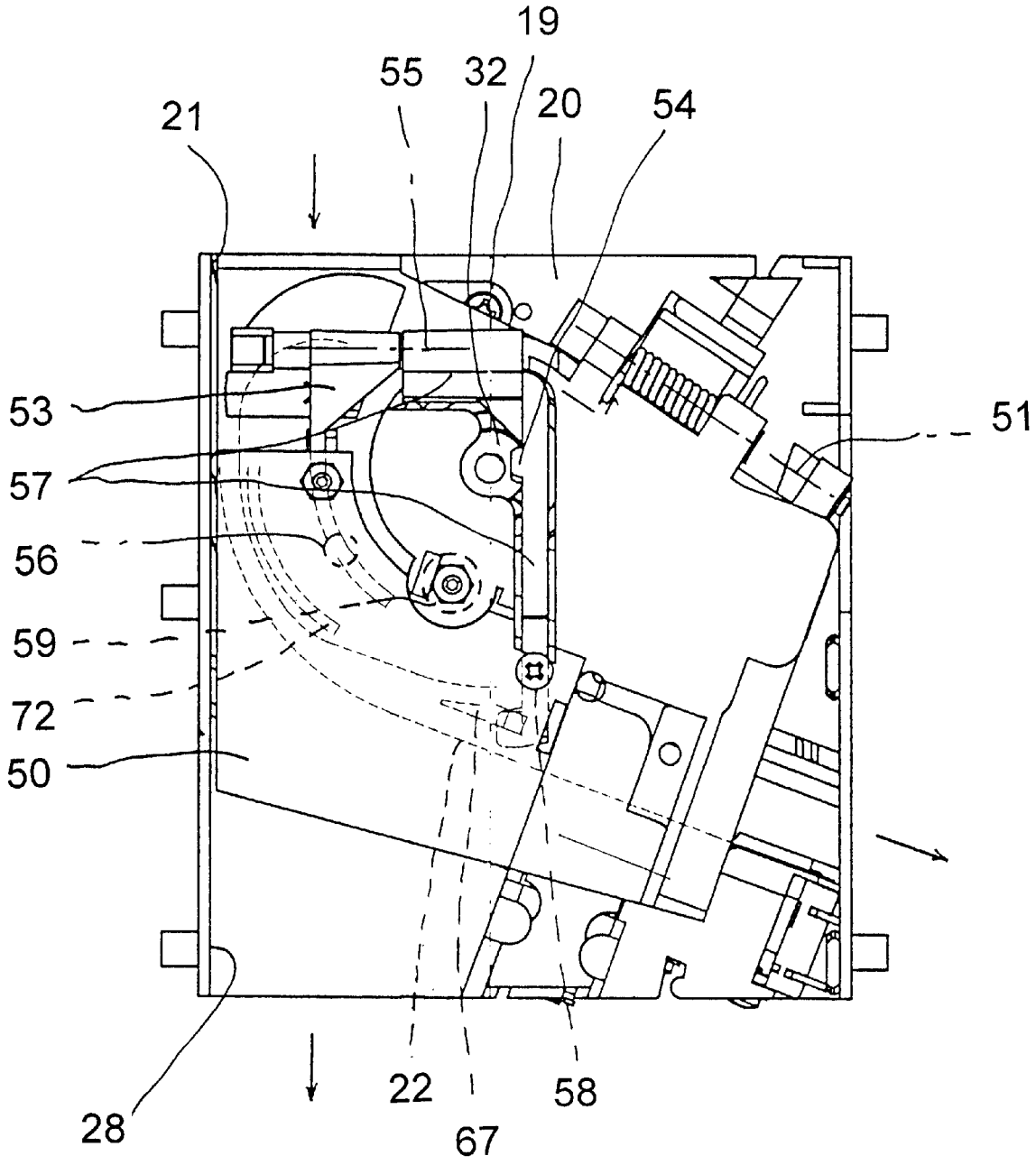
FIG. 2 is a front elevation view of the embodiment of FIG. 1.
Figure 3:
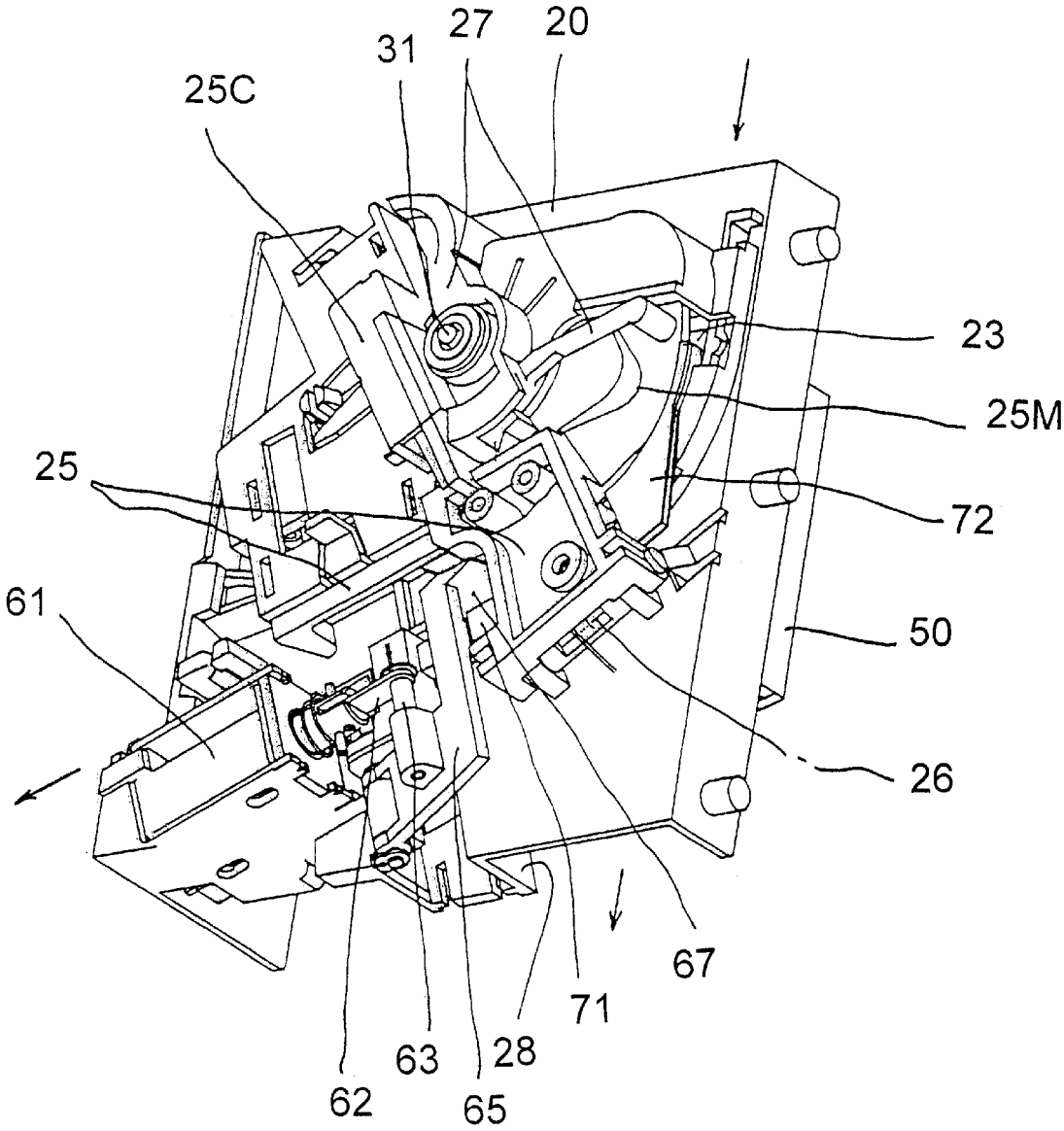
FIG. 3 is a summary perspective view in which the practical example of FIG. 1 is diagonally observed from the lower back.
Figure 4:
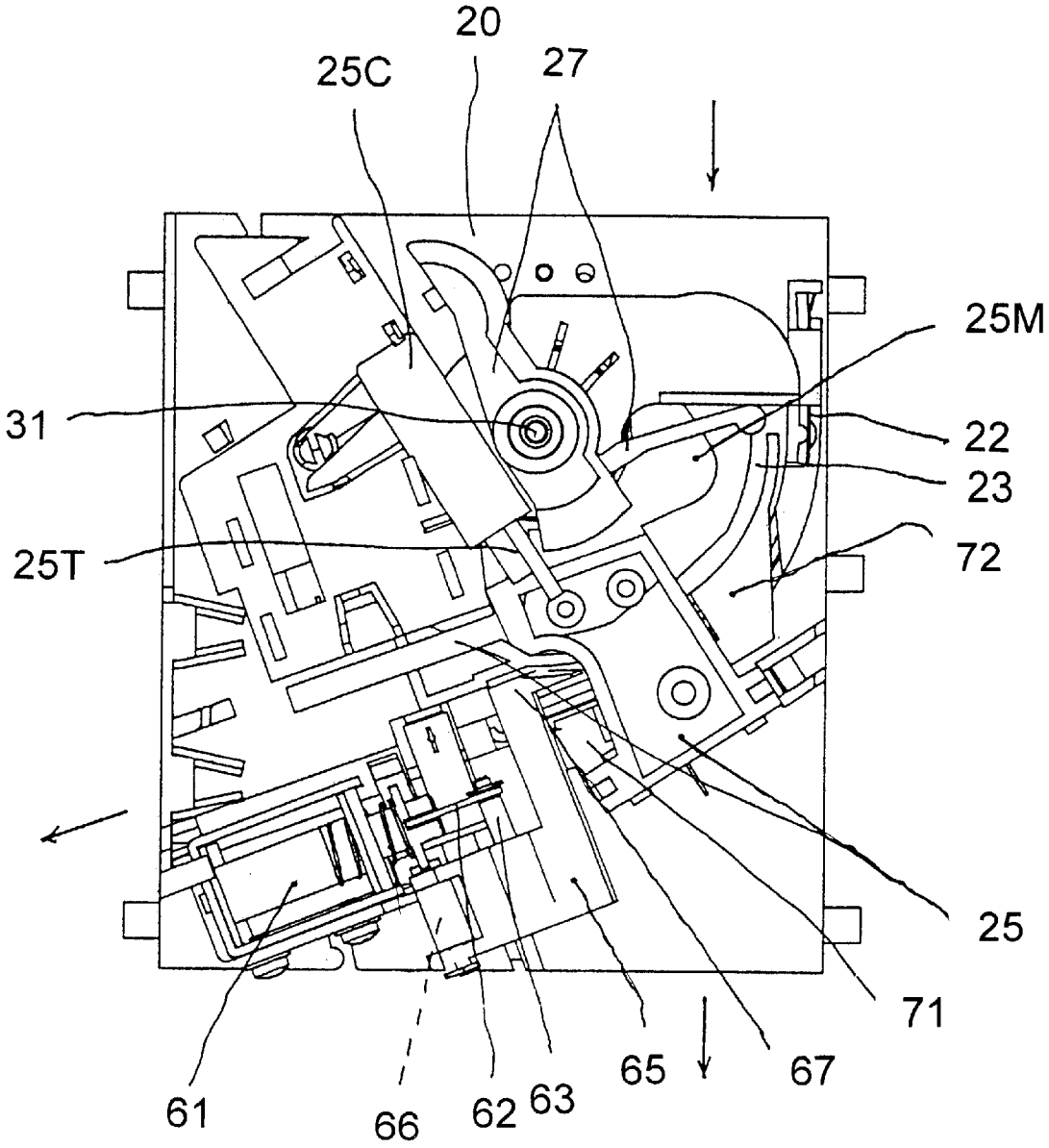
FIG. 4 is a rear view of the embodiment of FIG. 1.
Figure 7:
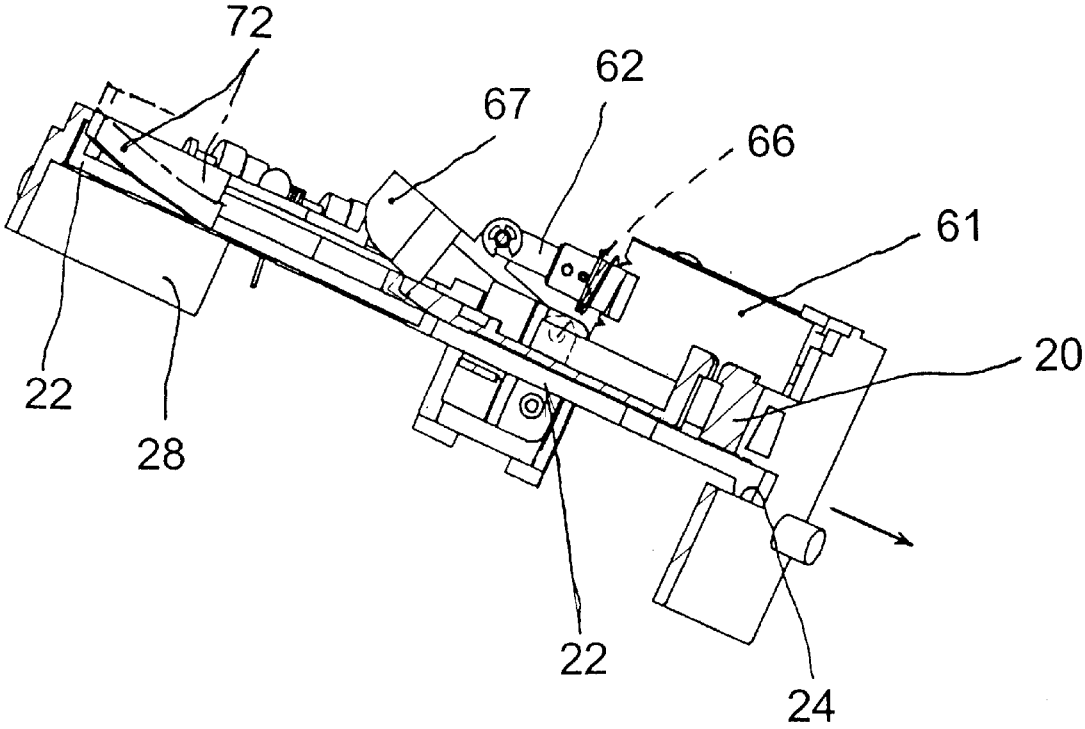
FIG. 7 is a sectional view of the embodiment of 5, observed from the top.
Figure 8:
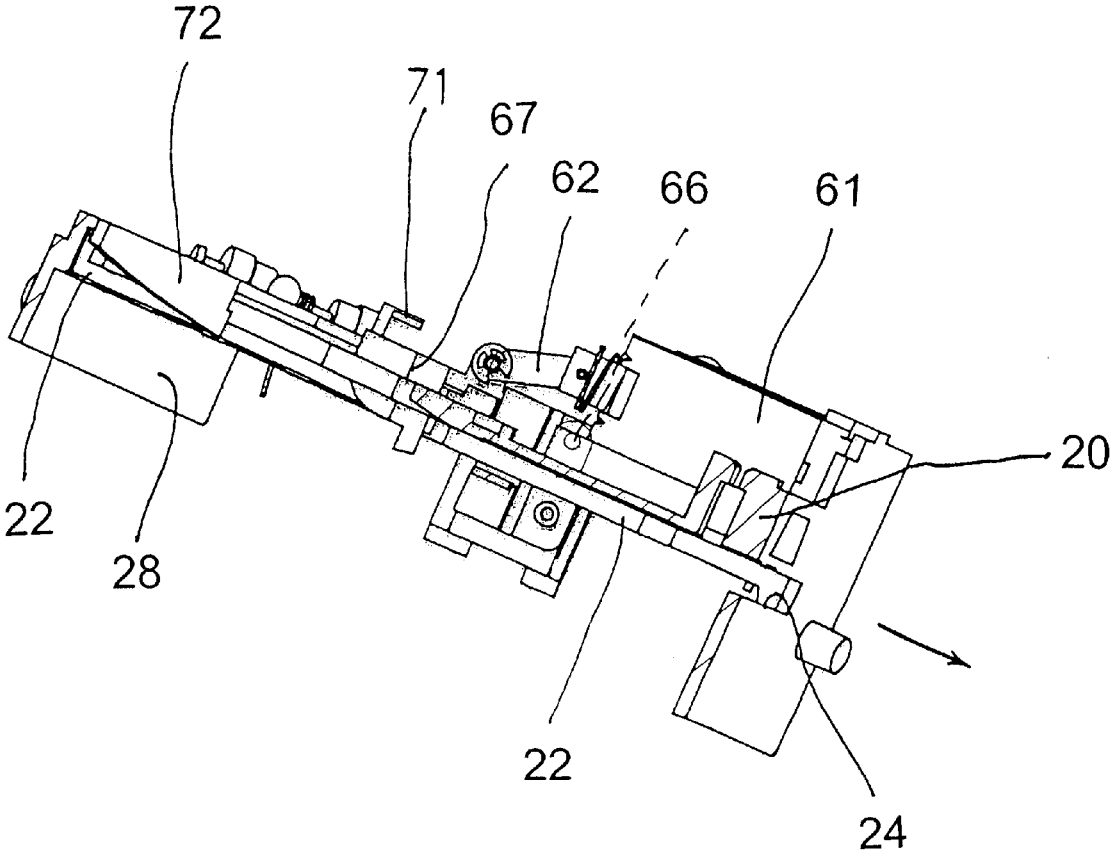
FIG. 8 is also a sectional view in which of the embodiment of FIG. 5 is observed from the top.

A small spherical body 59 is stationed at the center inside of cover body 50 (refer to FIG. 2). This spherical body 59 is arranged so as to be freely aproachable to base element 20. Spherical body 59 is used in order to adjust the width of the coin passage in proportion to the genuine coin thickness. A small rectangular body which is shown at the lower left on FIG. 3 is a solenoid 61. On the plunger of solenoid 61, a small elliptical link 62 is pivoted. Further, on this tip of link 62, a vertical shaft 63 is pivoted. At the lower end of vertical shaft 63, a generally F-shaped gate 65 is fixed. F-shaped gate 65 is a synthetic resin-molded product. The bottom base end of gate 65 is pivoted at 66 on base element 20 (refer to FIG. 4). This top tip 67 of gate 65 protrudes above the rail 22 freely (refer FIGS. 7 and 8). On the pivot shaft 26, a generally bow-shaped sub gate 72 is also hinged (refer to FIG. 3). A small spring (not shown) is placed between sub gate 72 which is a resin molded article and the cancel body 25. The center piece of F-shaped gate 65 comes to freely contact the base end part 71 of sub gate 72. When solenoid 61 is energized on, the gate 65 is rotated around pivot shaft 66, resisting the spring. As a result, the top tip 67 of gate 65 leaves the higher place of rail 22 (refer to FIG. 7). Simultaneously, the center piece of gate 65 contacts with the base end part 71 of sub gate 72, and moves this sub gate (refer to the chain line of FIG. 7). Thus, the deposited coin will pass through rail 22 without stopping by gates 72 and 67. That is to say, when solenoid 61 is energized on, the coin is rolling on rail 22 and guided to exit 24. The coin which is guided to exit 24 is stored for example in the cash safe box (not shown). When solenoid 61 is not energized or off, the spring works and gate 65 is rotated around pivot shaft 66. As a result, top tip 67 of gate 65 is located above the rail 22 (refer to FIG. 8). Simultaneously, center piece of gate 65 separates from base end 71 of sub gate 72. Sub gate 72 becomes free and is located above rail 22, by the action of spring (not shown). Thus, the coin which is deposited in opening 21 is guided to the cancel path 28, by sub gate 72 (refer to FIG. 5). Therefore, top tip 67 of gate 65 is not damaged by the coin. When the deposited coin has passed the position of sub gate 72, this is a case in which this coin is canceled. Even in this case, the coin is surely guided to cancel path 28, by top tip 67 of gate 65. That is to say, when the solenoid 61 is off, the genuine coin, which moves on rail 22, is also stopped and falls.

Figure 6:
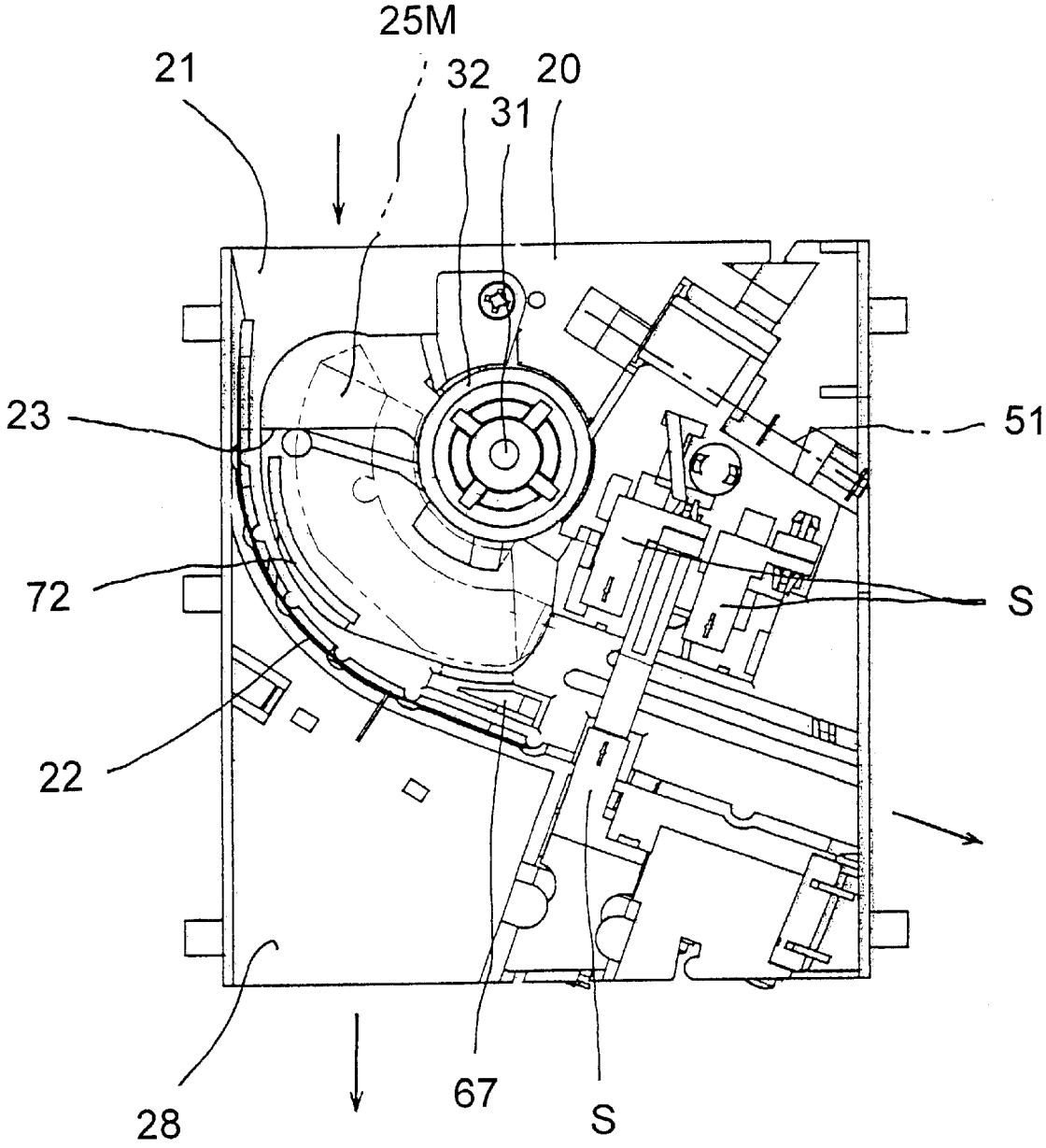
FIG. 6 is a front elevation view of the part of the embodiment of FIG. 5.

Near the lower end of rail 22, sensors S for counting coins are properly placed (refer to FIG. 6). These sensors S, for example, magnetically and optically detect the coin which passes the rail 22.

A rolling style selector of this practical example, which includes the above-mentioned constituents, is generally used with the solenoid 61 being ON. That is to say, top tip 67 of gate 65 and sub gate 72 are removed from the higher place of rail 22, and the selector is used (refer to FIG. 7). In this condition, when the coin is deposited into opening 21, the coin stands up and rolls along rail 22. If this standing and rolling coin is genuine, the coin passes through rails 22. This now sorted-out coin has the lower edge of the rolling coin guided by rail 22 and the upper edge thereof is guided by groove 33 of roller 32 (refer to FIG. 5). In the case that coin is genuine, the coin passes rail 22 smoothly and further will roll downwardly. As the roller 32 freely rotates in this case, the genuine coin smoothly and swiftly passes the roller position. Each of springs 56 and 58 applies a weak resilient force (refer to FIG. 2).

In the case that the coin which is put into opening 21 is not genuine and has a small diameter, rail 22 is not passed. In this case, though the lower edge of the coin is guided by rail 22, the upper edge thereof is not guided. Therefore, the small diameter coin deviates from rail 22, and falls in cover body 50, namely to the cancel path 28. If the small coin vibrates (causing ad apparent diameter increase) and as the coin reacts like a genuine coin, this vibration is absorbed by spring 56. With such a smaller coin diameter, the coin will be surely canceled, coming off from roller 32.

In the case that the coin deposited into opening 21 is not genuine and has a large diameter, long rail 22 is not passed. Although the lower edge of large coin is guided by rail 22, the upper edge of this coin hits roller 33. As the diameter of the coin is great, the coin is blocked between rail 22 and roller 32 and does not roll. In this case, cancel body 25 is moved around pivot shaft 26. The coin falls into the cancel path 28. The crescent moon board 25M is moved by the operation of cancel body 25. Simultaneously, by means of operation piece 25P, cover body 50 is opened and closed (refer to FIG. 11). The guide slope of groove 33 on roller 32 is the single unit in this practical example (it is of course possible to provide two guide slopes). On the whole circumference at the outside end part of roller 32, the groove 33 is formed. The groove 33 is generally U-shaped in cross section (refer to FIG. 5). This groove 33 is for guiding the upper part of circumference edge of the standing coin, which rolls down the rail 22. The groove 33 may advantageously be formed in a generally V-shape in cross section. The groove 33 may also be formed to be generally L-shaped in cross section. The outside top face of groove 33 may be sloped. The edge of coin is guided into the groove 33 of roller 32. The number of guide slopes of groove 33 on roller 32 may be two.

When the coin to be selected is changed in this practical example, only roller 32 is changed. When the diameter of the coin to be selected is changed the replacement of roller 32 is all that is required. When the thickness of selection coin is changed the replacement of roller 32 is all that is required. Solenoid 61 is energized on in during such use and is not energized when trouble occurs. In which case, the coin is canceled, even if the coin which is put into opening 21 is genuine.

Figure 9:
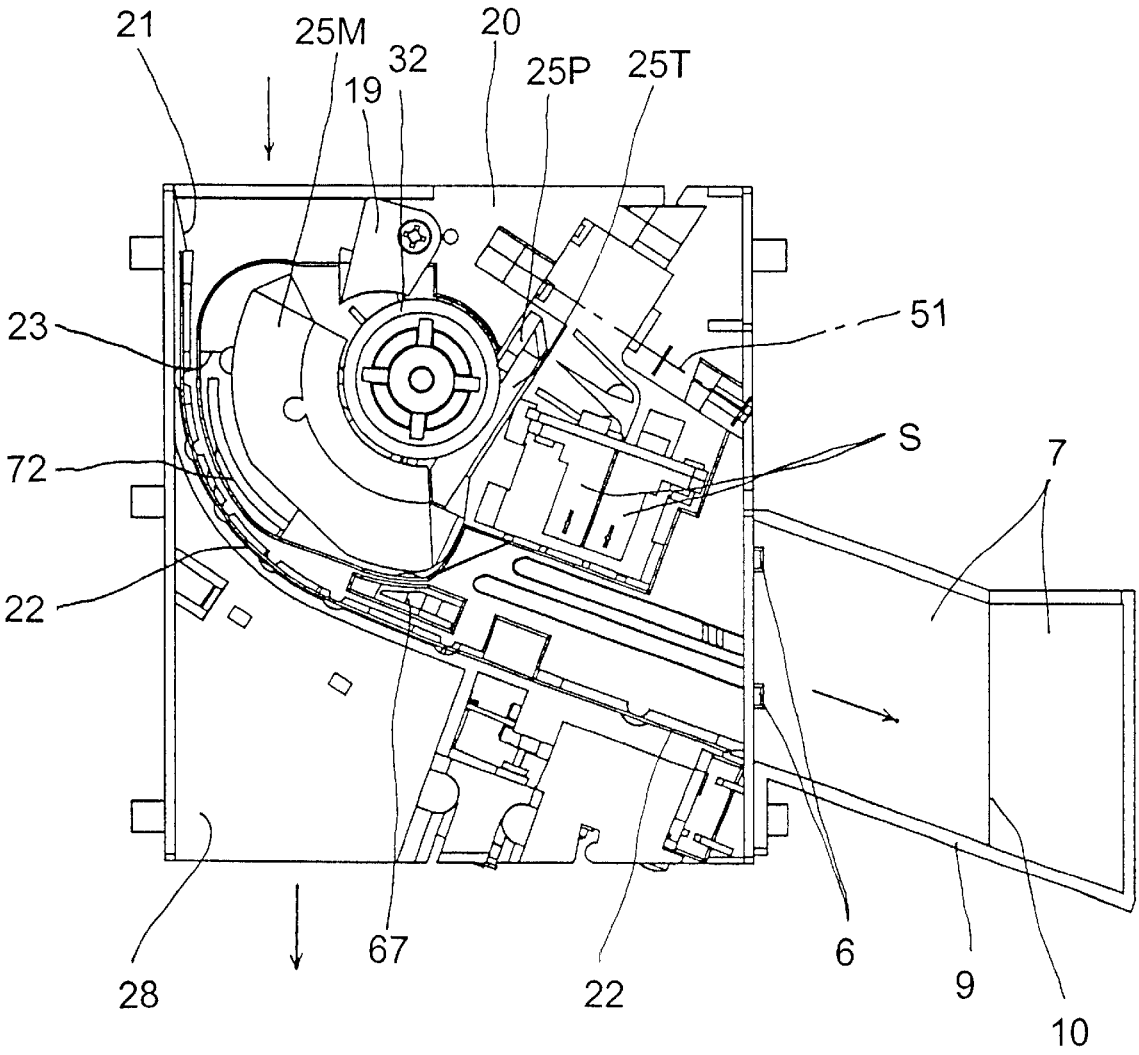
FIG. 9 is a front elevation view which summarily shows a second embodiment according to this invention.
Figure 10:
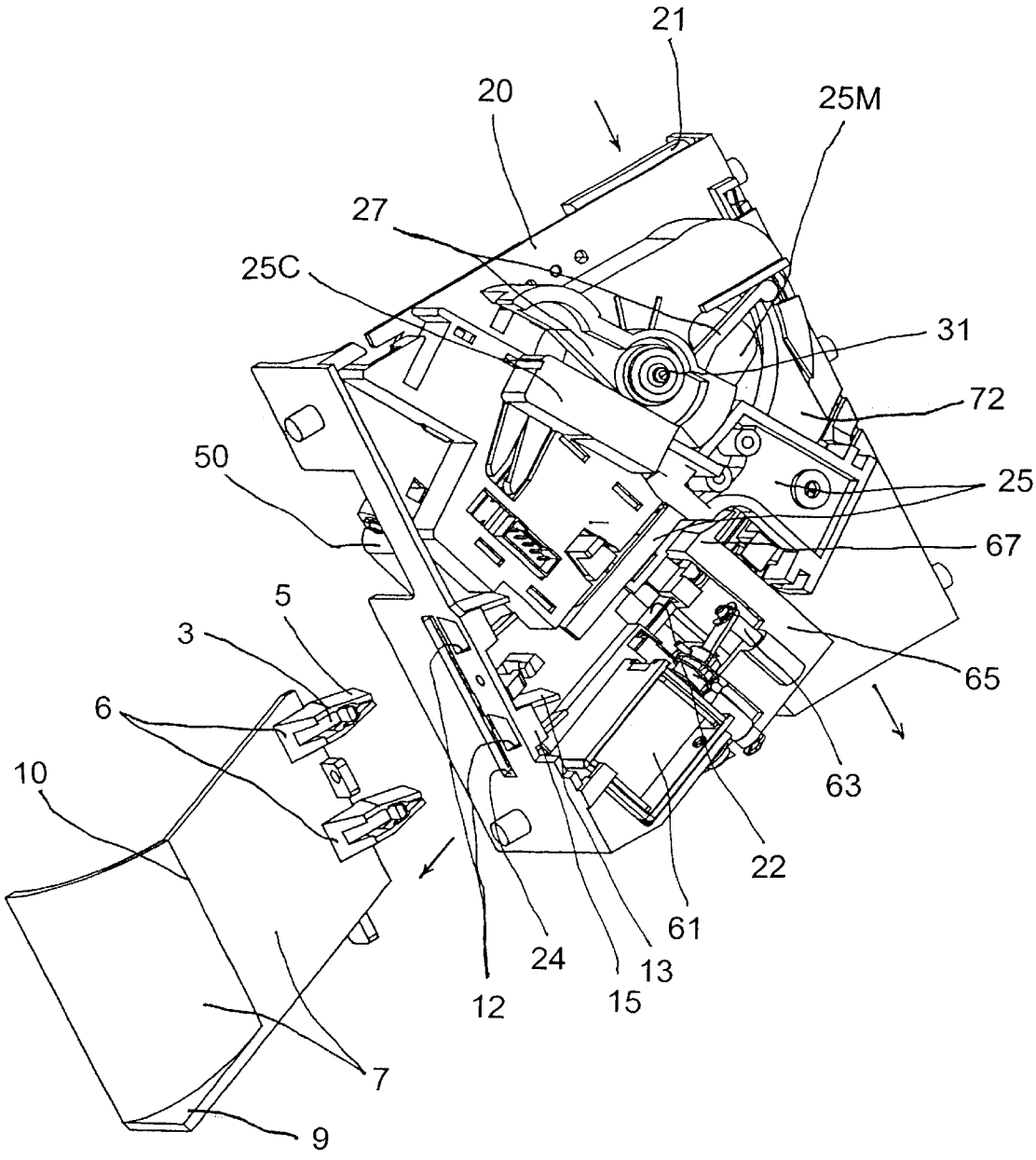
FIG. 10 is a perspective view which shows of the embodiment of FIG. 9 with parts removed.

In FIG. 9 a front elevation view shows a second embodiment according to this invention. FIG. 10 shows a perspective view of the FIG. 9 embodiment, with some parts removed. Reference numbers in the drawings used in FIGS. 1 to 8 are again used to identify similar structure.

The second practical example is a generally fish-tail-shaped chute body 10. This chute body 10 is a synthetic resin-molded product with a little elasticity, and is freely installed on the base element 20. The chute body 10 is used in order to guide the coin which is discharged from the exit 24 of base element 20, for desired position. Chute body 10 has a base plate portion 9 and a guide board portion 7 which is integral and which stands up from this base plate portion 9. Slender base plate portion 9 is obliquely formed in order to be flushed to rail 22 at the exit 24 (refer to FIG. 9). A guide board portion 7 stands up integrally on one side of base plate portion 9, and the lower end part thereof is bent. On the upper end part of guide board portion 7, a pair of male portions 6 constitute coupler means. The male portions 6 are formed integrally of guide board portion 7.

Each of male portions 6 has a pair of guide pieces 5 which roughly form a hollow triangular cone shape, respectively. Further, each male portion 6 has a small L-formed hook piece 3 between paired guide pieces 5, respectively (refer to FIG. 10). These guide pieces 5 and hook pieces 3 respectively have elasticity. A pair of female portions which constitute the above-mentioned coupler means are formed near the exit 24 of base element 20, respectively. Each female portion has a trapezoidal hole 12 for accepting paired guide pieces 5, respectively. Each female portion has a pair of taper walls 13 for guiding a pair of inserted guide pieces 5, respectively. In addition, each female portion has a stopper wall 15 for retaining male portion 6. Thus, when chute body 10 is installed on base element 20, each male portion 6 is inserted into each hole 12, first of all. Concretely, paired guide pieces 5, which are generally a hollow cone shape, are inserted into one of trapezoidal holes 12, resisting the elasticity. Therefore, chute body 10 can be accurately installed on base element 20 without installation work at the inside and outside.

Next, pushing the chute body 10 to base element 20, the tip of hook piece 3 is pressed and put into hole 12. The chute body 10 is pushed and the tip of hook piece 3 is put into hole 12, resisting the elasticity. When the tip of hook piece 3 is inserted into hole 12, the whole of male portion 6 penetrates almost in hole 12. Thus, the hook piece 3 which is passed through hole 12 is caught on stopper wall 15, via the stabilizing force of the elasticity. That is to say, hook piece 3 is entangled on stoppers wall 15, and chute body 10 is held tightly relative to the base element 20.

When chute body 10 is detached from base element 20, the tip of hook piece 3 is lowered by pressing resisting the elasticity. The tip of hook piece 3 is depressed to remove the chute body 10 from the stopper wall 15 as well as for inserting it into hole 12. When the tip of hook piece 3 is put into hole 12, male portion 6 is smoothly separated from the female portion. As this result, chute body 10 is detached from base element 20 (refer to FIG. 10).

Figure 11:
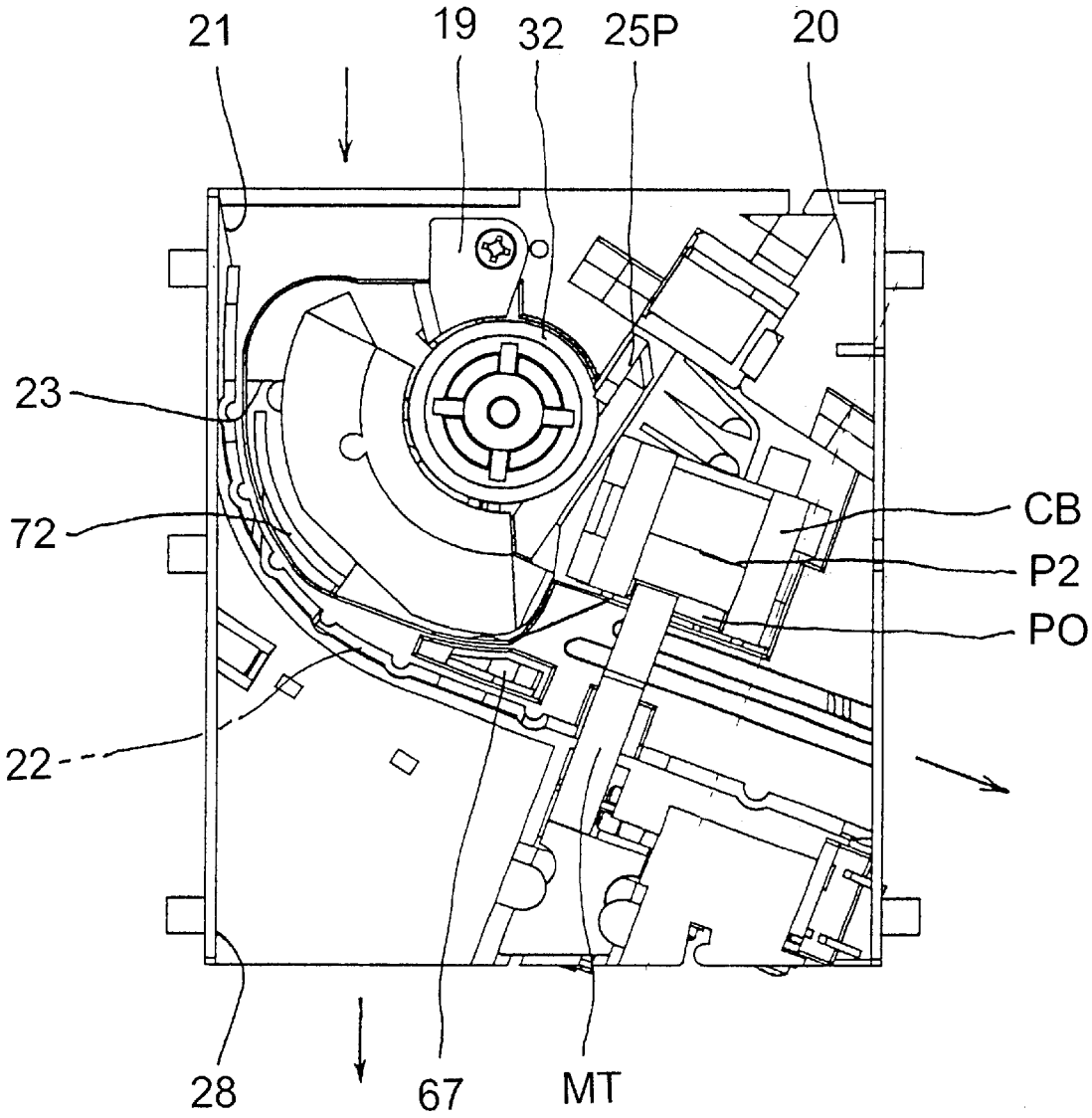
FIG. 11 is a front elevation view which summarily shows a third practical example according to the invention.
Figure 12:
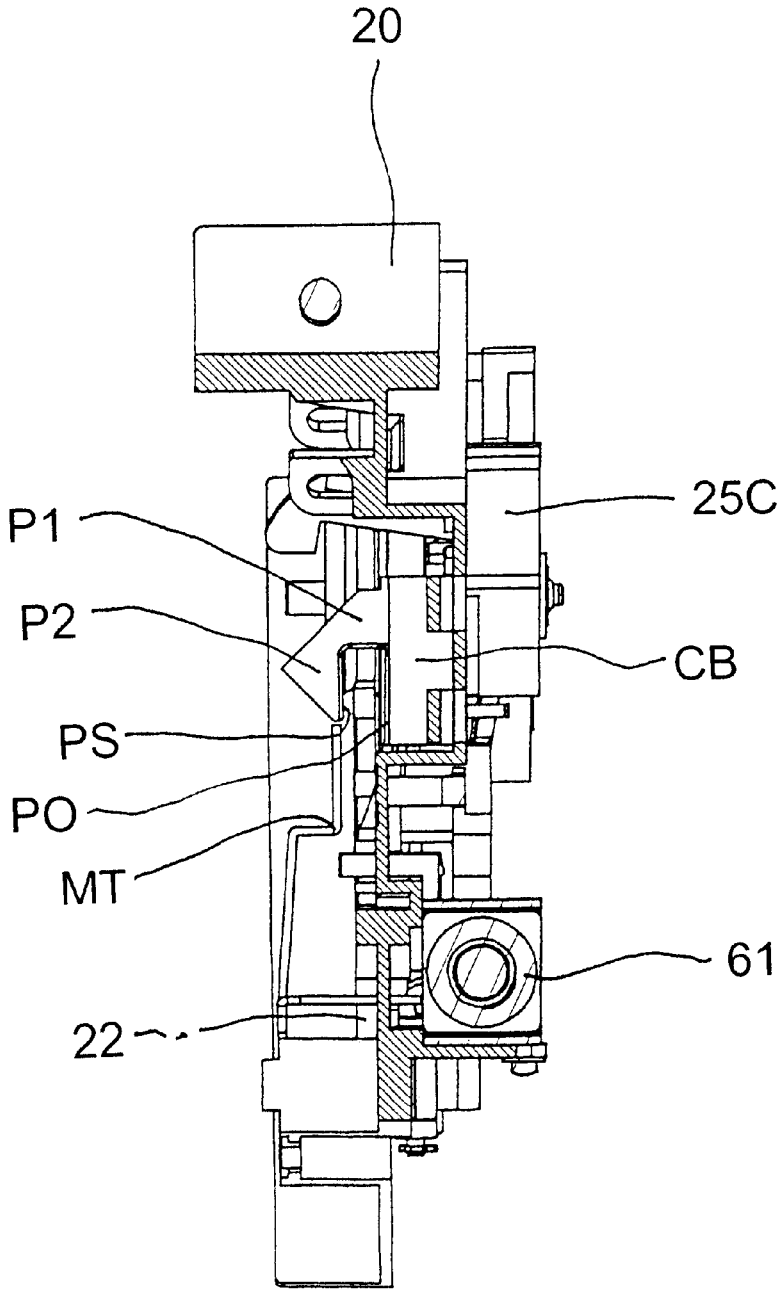
Figure 13A:
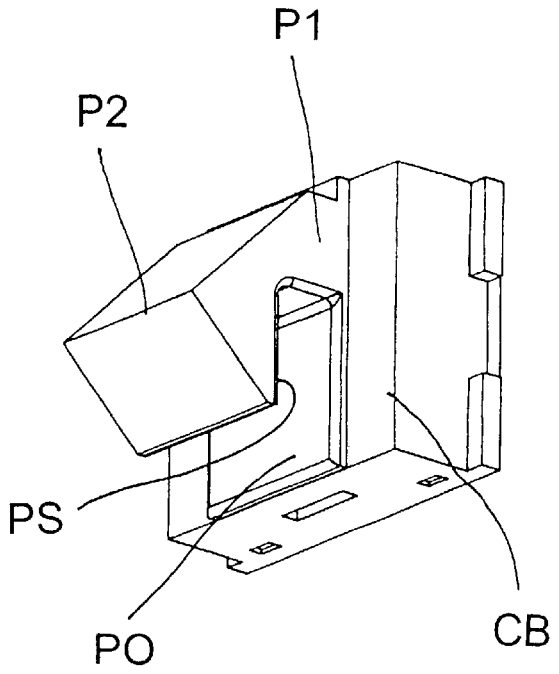
FIG. 13A is perspective view showing a main section of the third practical example according to the invention.
Figure 13B:
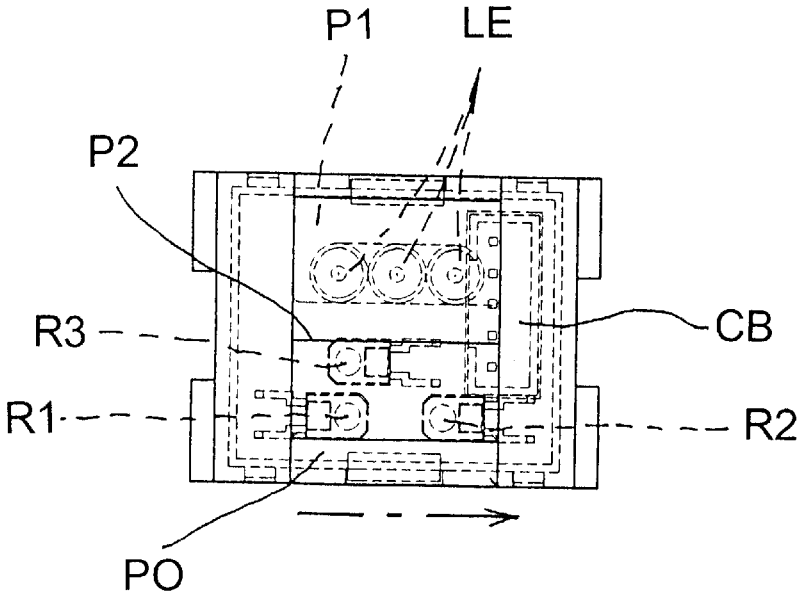
FIG. 13B is a front elevation view showing a main section of the third practical example according to the invention.
Figure 14A:
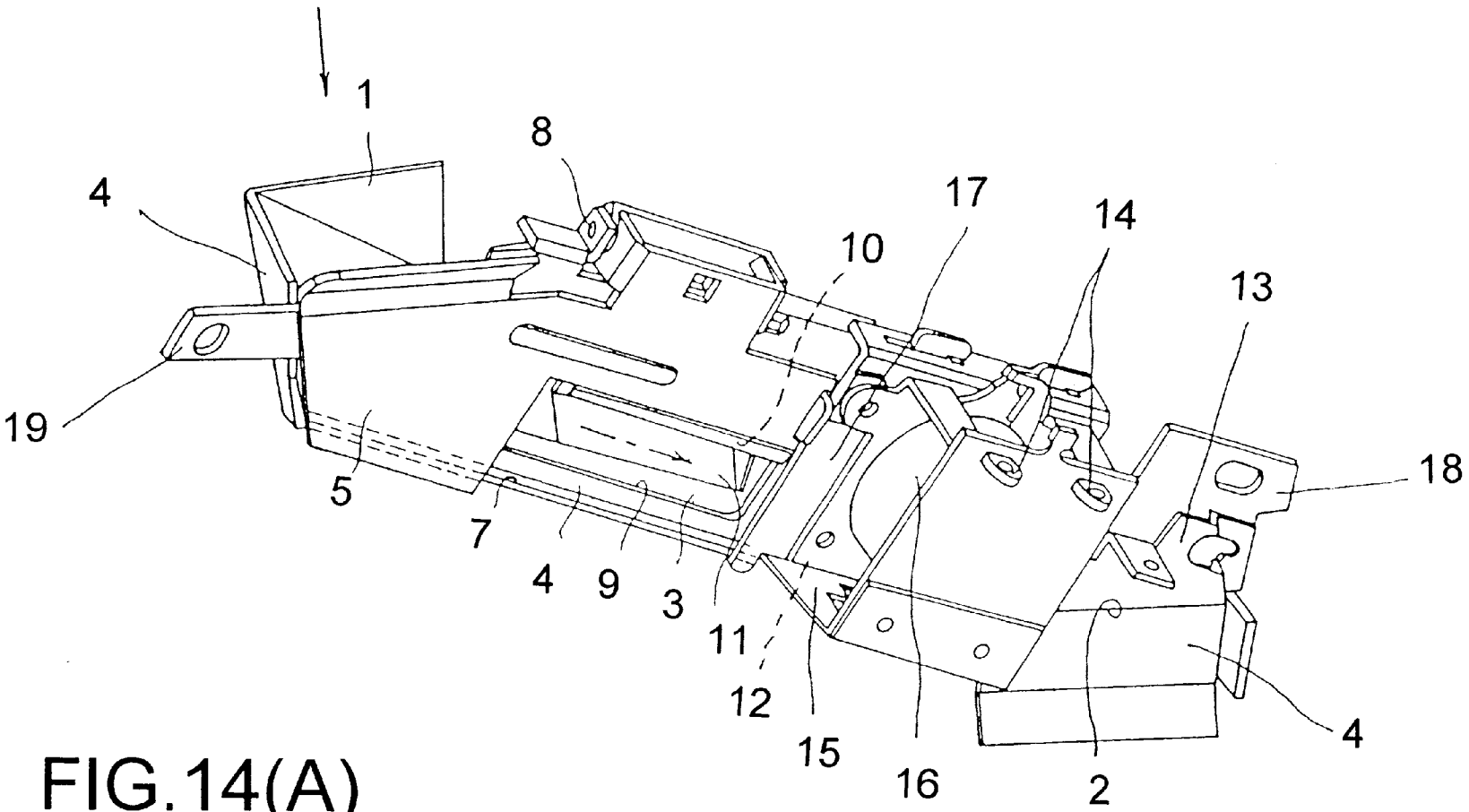
FIG.14(A) (PRIOR ART)
FIG. 14A is a perspective view which shows a known coin selector example.
Figure 14B:
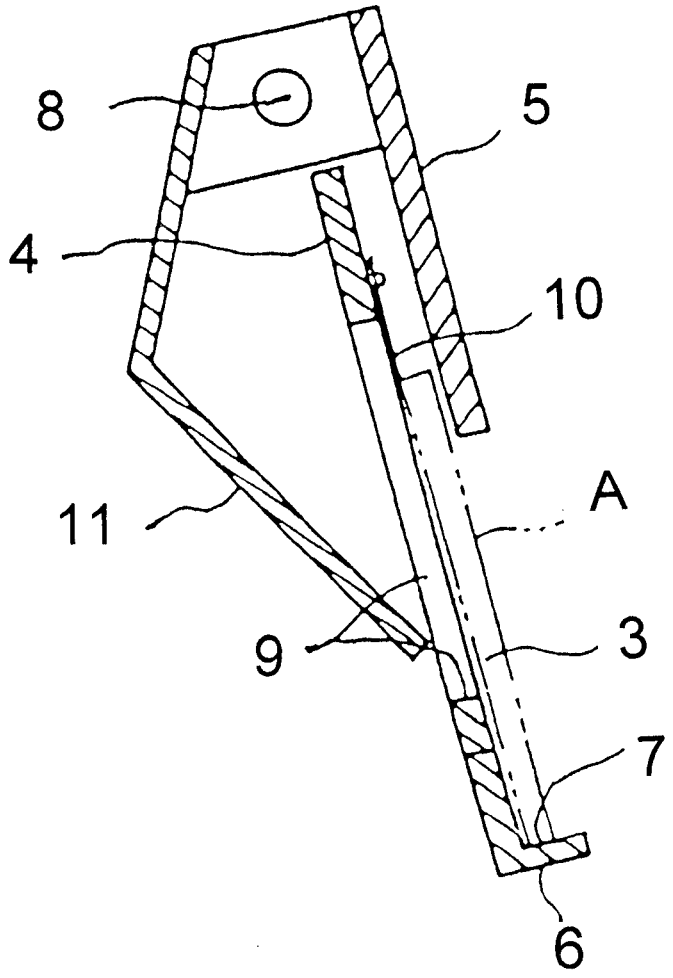
FIG.14(B) (PRIOR ART)
FIG. 14B is a sectional views which show the example of FIG. 14A.
Figure 15:
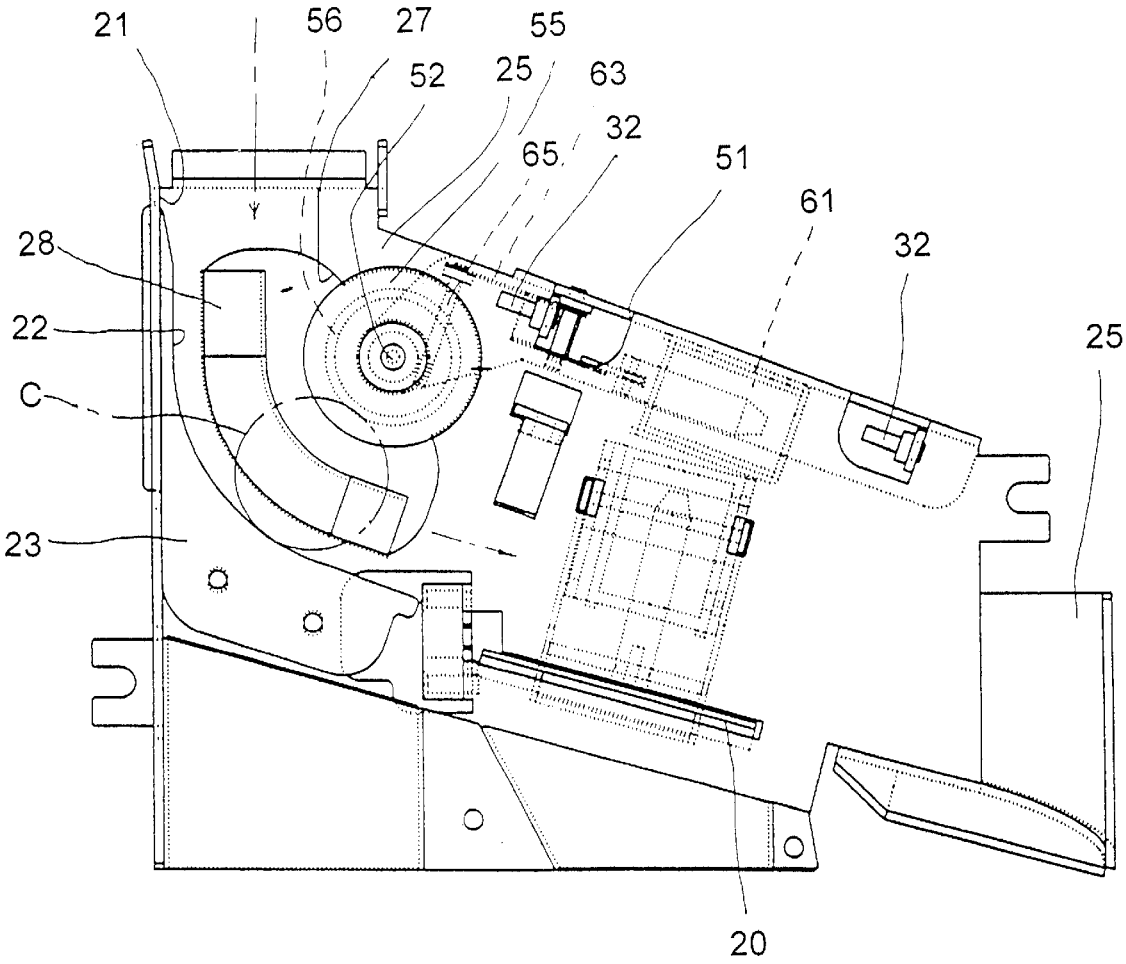
FIG.15 (PRIOR ART)
FIG. 15 is a front elevation view showing another known coin selector.

FIG. 11 shows a third practical example by this invention. FIG. 12 generally shows the sectional view of the FIG. 11 embodiment with FIG. 13 showing the main section. Reference numbers in the drawings used in FIGS. 1 to 10 are again used to identify similar structure.

Figure 16:
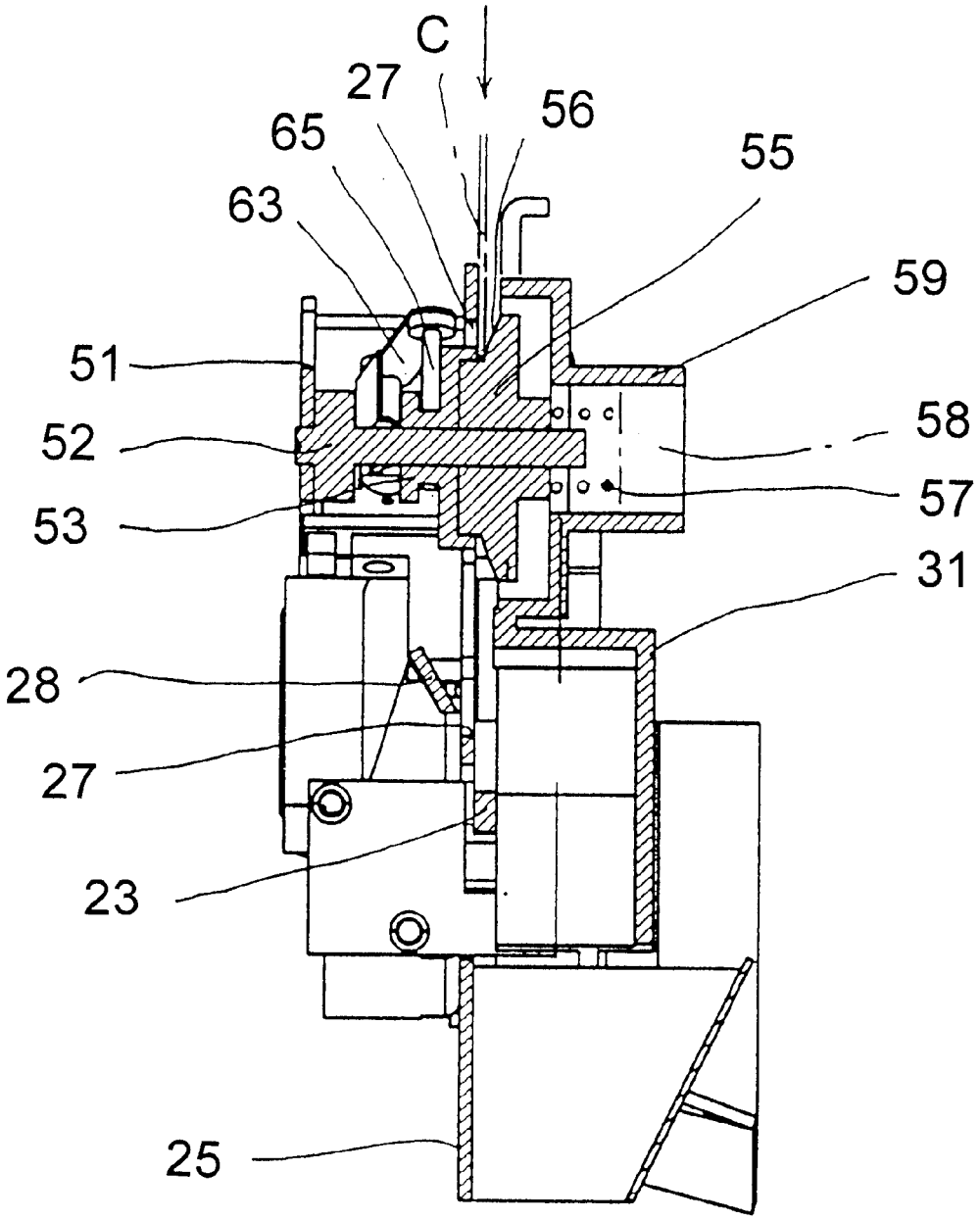
FIG.16 (PRIOR ART)
FIG. 16 is a summary sectional view showing the embodiment of FIG. 15.

The third practical example uses a prism element with generally roof shape (refer to FIG. 13). This prism element is a transparent synthetic resin molded product and has a mounting board portion P0 which is a rectangle thin plate. At an end part of mounting board portion P0 a generally right-angled-triangle shape is formed integrally. This has a primary reflection portion P1 at an end face. Further, on the tip edge of primary reflection portion P1, a second reflection portion P2 is formed integrally. The end face of this becomes a generally right-angled-triangle. In other words, the roof-shaped second reflection portion P2 is located above the center part of rectangular mounting board portion P0. The roof-shaped second reflection portion P2 is located on mounting board portion P0, exteding a distance PS. The prism mounting board portion P0 is installed on a substrate body CB for electronic circuits, resisting the elastic force (refer to FIG. 16). Substrate body CB exposes three light emitters LE and three photo-detectors R1, R2 and R3 on the surface thereof. These three light emitters LE radiate lights to primary reflection portion P1, respectively. The light which each light emitter radiates is, first of all, reflected by primary reflection portion P1, respectively. The light which is reflected by primary reflection portion P1 is again reflected at second reflection portion P2. The light which is reflected by second reflection portion P2 passes through the path PS. Such light that is passed through the path PS is detected at photo-detectors R1 and R2 and R3. The substrate body CB with prism is installed on base element 20 near roller 32, resisting the elastic force (refer to FIG. 11). When a standing up genuine coin rolls from the upper part of rail 22, the upper edge thereof will pass through the path PS. When the genuine coin passes the path PS, the coin passes through two photo-detectors R1 and R2 for coin counting. The third photo-detector R3 is used for prevention of tampering by mischief, etc. For example, when this third photo-detector R3 detects something, the equipment (not shown) on which this selector is installed is stopped. A long Z-shaped member which is shown under the substrate body CB with a prism is a metal plate MT for preventing tampering. This metal plate MT is fixed so that the upper end thereof may form the prism path PS (refer to FIG. 12). When cover body 50 is opened during cancel situations, etc., the metal plate MT prevents spacing near the path PS. In other words, by installing the metal piece MT, photo-detectors R1 and R2 for coin counting are not tampered with from outside the arrangement.

As described above, this invention can miniaturize the size of a whole selector by combining simple constituents. This invention provides for a lightening of the whole selector, by combining simple constituents. Also, in accordance with this invention, the size of a selected coin can be easily changed, only by changing the roller for a coin guide. Further, in accordance with this invention, the rail is freely detached so that the rail can be easily changed, such as if dirt is present.

While specific embodiments of the invention have been shown and described in detail to illustrate the application of the principles of the invention, it will be understood that the invention may be embodied otherwise without departing from such principles.

What is claimed is:

1. A coin selector for selecting rolling coins, the selector comprising:

a resin molded base element including a generally square upstanding plate and having an upper opening for receiving a deposited coin;

a rail arranged on said base element and being shaped as substantially one quarter of a circle extending from said upper opening into said base element, said rail standing up and rolling the deposited coin;

a resin molded roller arranged freely rotatable arranged above said rail and substantially at a center of said circle of said rail, said roller defining a groove for guiding an upper edge of the rolling deposited coin.

2. A coin selector according to claim 1, wherein said rail is a slender metal piece and is detachably fixed on said base element.

3. A coin selector according to claim 1, further comprising:

a chute body, said base element including a front face portion with a coin opening and having a chute connection opening adjacent to said coin opening, said chute body including a male portion with a guide piece, said chute connection opening accepting said guide piece for connecting said chute body to said base element.

4. A coin selector according to claim 3, wherein said male portion includes a tip of hook piece for fixing the chute body to the base element.

5. A coin selector according to claim 1, wherein said rail is a sheet metal piece.

6. A coin selector according to claim 1, wherein said roller is detachably fixed on said base element.

7. A coin selector for selecting rolling coins, the selector comprising:

a base element with including a generally square upstanding plate;

a rail arranged on said base element, said rail for standing up and rolling a deposited coin, said rail being removably connected to said base element;

a resin molded product roller with a groove, said roller being freely rotatable arranged above said rail, and guiding the upper edge of the rolling coin;

a prism shaped element formed of a transparent synthetic resin molded product with a mounting board portion and a primary reflection portion at an end face and a second reflection portion formed integrally.

8. A coin selector according to claim 7, further comprising: light emitters and three photo-detectors on the surface of said prism shaped element.

* * * * *